US011482149B2

(12) United States Patent
Wang

(10) Patent No.: US 11,482,149 B2
(45) Date of Patent: Oct. 25, 2022

(54) SIGNAL CONTROLLING DEVICE, DISPLAY DRIVING DEVICE, DISPLAY APPARATUS AND DISPLAY DRIVING METHOD

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Zhu Wang, Beijing (CN)

(73) Assignees: Chengdu BOE Optoelectronics Technology Co., Ltd., Sichuan (CN); Beijing BOE Technology Development Co., Ltd., Beijing (CN)

( * ) Notice: Subject to any disclaimer, the term of this patent is extended or adjusted under 35 U.S.C. 154(b) by 6 days.

(21) Appl. No.: 16/649,642

(22) PCT Filed: Apr. 18, 2019

(86) PCT No.: PCT/CN2019/083158

§ 371 (c)(1),
(2) Date: Mar. 21, 2020

(87) PCT Pub. No.: WO2019/201289

PCT Pub. Date: Oct. 24, 2019

(65) Prior Publication Data

US 2020/0258438 A1 Aug. 13, 2020

(30) Foreign Application Priority Data

Apr. 20, 2018 (CN) ..... 201810360261.2

(51) Int. Cl.
*G09G 3/20* (2006.01)

(52) U.S. Cl.
CPC ..... *G09G 3/20* (2013.01); *G09G 2310/0278* (2013.01); *G09G 2310/08* (2013.01)

(58) Field of Classification Search
CPC ..... G09G 3/3685–3688; G09G 3/3275–3291; G09G 3/20; G09G 2310/08; G09G 2310/0278
See application file for complete search history.

(56) References Cited

U.S. PATENT DOCUMENTS

2003/0210215 A1* 11/2003 Takahashi ..... G06F 3/1431 345/87
2005/0168429 A1* 8/2005 Chou ..... G09G 3/3688 345/100

(Continued)

FOREIGN PATENT DOCUMENTS

CN 1744773 A 3/2006
CN 101145326 A 3/2008

(Continued)

OTHER PUBLICATIONS

First Office Action and English language translation, CN Application No. 201810360261.2, dated Nov. 29, 2019, 18 pp.

(Continued)

*Primary Examiner* — Hang Lin
(74) *Attorney, Agent, or Firm* — Myers Bigel, P.A.

(57) ABSTRACT

The present disclosure relates to a display driving device, a display apparatus, a display driving method and a signal controlling device. The signal controlling device includes a scanning signal controlling device configured to output a scanning signal that initiates a scanning of a pixel array, and an image data segmenting device configured to receive the scanning signal and a data signal representing a frame of image from a data source, and to segment the data signal in response to the scanning signal to output a first set of image data signals and a second set of image data signals. The first set of image data signals comprises data information of a first set of column pixels in the frame of image and the (Continued)

second set of image data signals comprises data information of a second set of column pixels in the frame of image.

17 Claims, 6 Drawing Sheets

(56) References Cited

U.S. PATENT DOCUMENTS

2006/0044252 A1* 3/2006 Ryu ..... G09G 5/399 345/98
2008/0068322 A1* 3/2008 Lee ..... G09G 3/3688 345/96
2012/0200770 A1 8/2012 Choi et al.
2013/0335395 A1 12/2013 Zhan et al.
2017/0269416 A1* 9/2017 Miao ..... G09G 3/3688
2020/0258438 A1 8/2020 Wang

FOREIGN PATENT DOCUMENTS

| | | | |
|---|---|---|---|
| CN | 201266288 | Y | 7/2009 |
| CN | 102629445 | A | 8/2012 |
| CN | 108538234 | A | 9/2018 |
| JP | 2015018100 | A | 1/2015 |
| KR | 20080001890 | A | 1/2008 |

OTHER PUBLICATIONS

Notice of Second Review Opinion and English language translation, CN Application No. 201810360261.2, dated Sep. 1, 2020, 23 pp.

* cited by examiner

SIGNAL CONTROLLING DEVICE, DISPLAY DRIVING DEVICE, DISPLAY APPARATUS AND DISPLAY DRIVING METHOD

CROSS-REFERENCE TO RELATED APPLICATIONS

The present application is a 35 U.S.C. 371 national stage application of PCT International Application No. PCT/CN2019/083158, filed on Apr. 18, 2019, which claims the benefit of Chinese Patent Application No. 201810360261.2, filed on Apr. 20, 2018, the entire disclosures of which are incorporated herein by reference.

TECHNICAL FIELD

The present disclosure relates to the field of display technologies, and particularly to a signal controlling device, a display driving device, a display apparatus and a display driving method.

BACKGROUND

As people are setting higher requirements for a display image, increasing attention is paid to an ultra-high resolution display apparatus represented by a virtual reality display apparatus. In order to improve the quality of a display image, an ultra-high resolution display apparatus with 1000 PPI and a frequency of 120 Hz is used for image display, so that the image has an ultra-high resolution. However, the number of data channels in a current chip has reached a technological limit, so that the ultra-high resolution display apparatus uses two chips to transmit data signals, and meanwhile two sets of scanning driving signals are utilized to control the on/off of the pixel units of the ultra-high resolution display apparatus, so that the data signals transmitted by the two chips charge the switched-on pixel units. However, due to the difference in line resistances, the two set of scanning driving signals are not highly synchronized in the time dimension, so that the virtual display apparatus behaves poorly in image matching.

SUMMARY

According to an aspect of the present disclosure, there is provided a signal controlling device for providing an image data signal for a display apparatus comprising a pixel array, the signal controlling device comprising a scanning signal controlling device configured to output a scanning signal that initiates a scanning of the pixel array, and an image data segmenting device configured to receive the scanning signal and a data signal representing a frame of image from a data source, and to segment the data signal in response to the scanning signal to output a first set of image data signals and a second set of image data signals, wherein the first set of image data signals comprises data information of a first set of column pixels in the frame of image and the second set of image data signals comprises data information of a second set of column pixels in the frame of image.

According to an embodiment of the present disclosure, the first set of image data signals comprises data information of even-numbered column pixels in the frame of image and the second set of image data signals comprises data information of odd-numbered column pixels in the frame of image.

According to another aspect of the present disclosure, there is provided a display driving device for driving a display apparatus comprising a pixel array, the display driving device comprising: the signal controlling device as described above; a pixel array driver configured to receive the scanning signal and generate a pixel array driving signal in response to the scanning signal, to switch on pixel units in each row in the pixel array row by row; a first data driver configured to receive the first set of image data signals and the pixel array driving signal, generate a first set of data driving signals in response to the received signals, and supply power to corresponding pixel units of a first set of pixel units in the row of switched-on pixel units based on the first set of data driving signals; and a second data driver configured to receive the second set of image data signals and the pixel array driving signal, generate a second set of data driving signals in response to the received signals, and supply power to corresponding pixel units of a second set of pixel units in the row of switched-on pixel units based on the second set of data driving signals.

According to an embodiment of the present disclosure, the pixel array driver comprises a GOA circuit, and the pixel array driving signal is a gate line driving signal.

According to an embodiment of the present disclosure, the first data driver also generates a first triggering signal during the power supply to the corresponding pixel units of the first set of pixel units in the row of switched-on pixel units based on the first set of data driving signals, and transmits the first triggering signal to the second data driver so that the second data driver starts the power supply in response to the first triggering signal.

According to an embodiment of the present disclosure, the first data driver generates the first triggering signal at the beginning of the power supply to the corresponding pixel units of the first set of pixel units, or the first data driver generates the first triggering signal at the end of the power supply to the corresponding pixel units of the first set of pixel units.

According to an embodiment of the present disclosure, the display driving device also comprises a synchronous controlling device, the synchronous controlling device receives the pixel array driving signal, and transmits a second triggering signal to the first data driver and a third triggering signal to the second data driver in response to the pixel array driving signal, the first data driver starts to supply power to the corresponding pixel units of the first set of pixel units in the row of switched-on pixel units in response to the second triggering signal, and the second data driver starts to supply power to the corresponding pixel units of the second set of pixel units in the row of switched-on pixel units in response to the third triggering signal.

According to an embodiment of the present disclosure, there is provided a display apparatus, comprising a display panel comprising a pixel array, the display panel comprising n row driving lines and m data lines, n and m being integers greater than 1; and any display driving device as described above, wherein an output of the pixel array driver is connected to the n row driving lines; and wherein an output of the first data driver is connected with a first set of data lines of the m data lines, and an output of the second data driver is connected with a second set of data lines of the m data lines.

According to an embodiment of the present disclosure, the display panel is a liquid crystal display panel or an OLED display panel.

According to an embodiment of the present disclosure, the pixel array driver and the first data driver are integrated in a first chip, the second data driver is integrated in a second chip, and the first chip and the second chip are arranged in a same frame area of the display panel.

According to an embodiment of the present disclosure, the pixel array driver and the first data driver are integrated in a first chip, the second data driver is integrated in a second chip, and the first chip and the second chip are respectively arranged in opposite frame areas of the display panel.

According to an embodiment of the present disclosure, the signal controlling device is integrated in a processor which is connected to the first chip and the second chip by a flexible circuit board.

According to an embodiment of the present disclosure, the first set of data lines corresponds to a first set of column pixel units in the pixel array, and the second set of data lines corresponds to a second set of column pixel units in the pixel array.

According to an embodiment of the present disclosure, the first set of column pixel units comprises even-numbered column pixel units in the pixel array, and the second set of column pixel units comprises odd-numbered column pixel units in the pixel array.

According to an aspect of the present disclosure, there is provided a display driving method for driving the above display apparatus by using the above display driving device, comprising the following steps:

a) outputting a scanning signal by the scanning signal controlling device to initiate a scanning of the pixel array of the display apparatus;

b) segmenting the data signal of the frame of image by the image data segmenting device in response to the scanning signal to output the first set of image data signals and the second set of image data signals;

c) receiving the scanning signal by the pixel array driver and outputting the pixel array driving signal to the pixel array by the pixel array driver in response to the scanning signal, to switch on pixel units in each row in the pixel array row by row;

d) receiving the first set of image data signals and the pixel array driving signal by the first data driver, and generating the first set of data driving signals by the first data driver in response to the received signals, and supplying power to the corresponding pixel units of the first set of pixel units in the row of switched-on pixel units by the first data driver based on the first set of data driving signals; and e) receiving the second set of image data signals and the pixel array driving signal by the second data driver, and generating the second set of data driving signals by the second data driver in response to the received signals, and supplying power to the corresponding pixel units of the second set of pixel units in the row of switched-on pixel units by the second data driver based on the second set of data driving signals.

According to an embodiment of the present disclosure, the step e) of the above display driving method is replaced by the following steps:

f) generating also a first triggering signal during the power supply to the corresponding pixel unit of the first set of pixel units in the row of switched-on pixel units by the first data driver based on the first set of data driving signals, and transmitting the first triggering signal to the second data driver; and g) receiving the second set of image data signal, the pixel array driving signal and the first triggering signal by the second data driver, and generating the second set of data driving signals by the second data driver in response to the received signals, and supplying power to the corresponding pixel unit of the second set of pixel units in the row of switched-on pixel units by the second data driver based on the second set of data driving signals.

According to an embodiment of the present disclosure, the first triggering signal is generated when the first data driver starts the power supply to the corresponding pixel units of the first set of pixel units, or the first triggering signal is generated when the first data driver ends the power supply to the corresponding pixel units of the first set of pixel units.

According to an embodiment of the present disclosure, the display driving device also comprises a synchronous controlling device, and the steps d) and e) of the display driving method are replaced by the following steps:

h) transmitting the pixel array driving signal to the synchronous controlling device by the pixel array driver;

i) generating a second triggering signal transmitted to the first data driver and a third triggering signal transmitted to the second data driver by the synchronous controlling device in response to the pixel array driving signal;

j) receiving the first set of image data signals, the pixel array driving signal and the second triggering signal by the first data driver, and generating the first set of data driving signals by the first data driver in response to the received signals, and supplying power to the corresponding pixel units of the first set of pixel units in the row of switched-on pixel units by the first data driver based on the first set of data driving signals; and k) receiving the second set of image data signals, the pixel array driving signal and the third triggering signal by the second data driver, and generating the second set of data driving signals by the second data driver in response to the received signals, and supplying power to the corresponding pixel units of the second set of pixel units in the row of switched-on pixel units by the second data driver based on the second set of data driving signals.

BRIEF DESCRIPTION OF THE DRAWINGS

The embodiments of the present disclosure will be described in detail below with reference to the drawings, so as to facilitate better knowledge and understanding of the problem to be solved by the present disclosure, and the above and other objectives, features and advantages, wherein.

DETAILED DESCRIPTION

A signal controlling device, a display driving device, a display apparatus and a display driving method according to the embodiments of the present disclosure will be clearly and fully described below with reference to the accompanying drawings.

It will be understood that although terms such as "first", "second" and "third" can be used herein to describe various elements, components and/or parts, these elements, components and/or parts should not be restricted by the terms. These terms are only used to distinguish one element, component or part from another element, component or part. Therefore, the first element, component or part discussed below may also be referred to as the second or third element, component or part without departing from the teachings of the present disclosure.

The terms used herein are only used for the purpose of describing a particular embodiment, rather than limiting the present disclosure. As used herein, the singular forms of "a", "an" and "the" are also intended to include the plural forms, unless otherwise specified clearly in the context. It shall also be understood that the terms such as "comprise" and/or "include" used in the specification of the present disclosure indicate the presence of the features, entireties, steps, operations, elements and/or components, but do not exclude the presence of one or more other features, entireties, steps, operations, elements, components and/or groups thereof, or the addition of one or more other features, entireties, steps, operations, elements, components and/or groups thereof. Moreover, the term "and/or" used herein comprises any and all combinations of one or more of related items as listed.

Unless otherwise defined, all terms (including technical terms and scientific terms) used herein have the same meaning as commonly understood by one having ordinary skills in the art, to which the present disclosure belongs. It should be further understood that terms such as those defined in a common dictionary should be construed as having the same meaning as in the related art and/or in the context of the present specification, and will not be construed in an ideal or overly formal sense, unless defined explicitly as such herein.

The technical features included in the embodiments described below in the present application may be combined freely without violating the technical principle, and the technical solutions obtained from the combinations shall also be considered as falling within the scope of the present disclosure.

Some techniques, structures and materials commonly known in the art of this disclosure are not described in detail for the sake of clarity so as to avoid making the present application lengthy.

Figure 1:
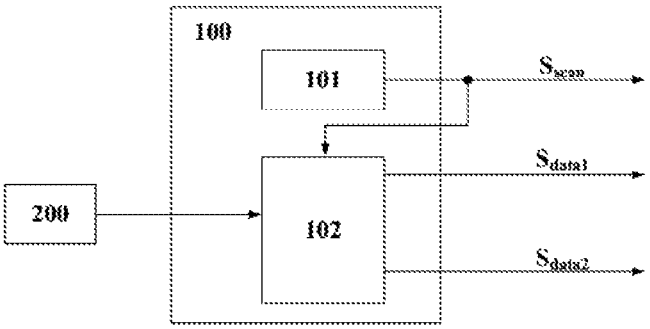
FIG. 1 is a schematic structural block diagram of a signal controlling device according to an embodiment of the present disclosure.

With reference to FIG. 1, it shows a signal controlling device 100 according to an embodiment of the present disclosure. The signal controlling device 100 is used to provide a signal for a display apparatus including a pixel array, and the display apparatus may be any product or component including a pixel array and having a display function, such as a mobile phone, a tablet computer, a television, a display, a laptop computer, a digital photo frame, a navigator, a virtual reality (VR) display apparatus, and an augmented reality (AR) display apparatus. The signal controlling device 100 comprises a scanning signal controlling device 101 and an image data segmenting device 102. The scanning signal controlling device 101 generates a scanning signal $S_{scan}$ that initiates the scanning of the pixel array in the display apparatus. The scanning signal $S_{scan}$ is also transmitted to the image data segmenting device 102. The image data segmenting device 102 receives a data signal representing a frame of image from a data source 200, and segments the data signal into a first set of image data signals $S_{data1}$ and a second set of image data signals $S_{data2}$ in response to the scanning signal $S_{scan}$. The first set of image data signals $S_{data1}$ comprises data information of a first set of column pixels in the frame of image and the second set of image data signals $S_{data2}$ comprises data information of a second set of column pixels in the frame of image. When the pixel units in the pixel array of the display apparatus are switched on row by row, a corresponding drive circuit may supply power to the corresponding pixel units of the first set of pixel units in the row of switched-on pixel units based on the first set of image data signals $S_{data1}$, and the corresponding drive circuit may also supply power to the corresponding pixel units of the second set of pixel units in the row of switched-on pixel units based on the second set of image data signals $S_{data2}$. For instance, as for a liquid crystal display panel, supplying power to the corresponding pixel unit means charging a capacitor in the corresponding pixel unit through a data line; and as for an OLED display panel, supplying power to the corresponding pixel unit means supplying power to a corresponding control circuit so as to light up an OLED in the corresponding pixel unit. Thus, the signal controlling device 100 can segment the data signal of the frame of image to be displayed in response to each signal (i.e. a scanning signal $S_{scan}$) that initiates scanning of the pixel array in the display apparatus, so as to generate the first set of image data signals $S_{data1}$ and the second set of image data signals $S_{data2}$, which correspond to the scanning signal $S_{scan}$.

In another embodiment of the present disclosure, the first set of image data signals $S_{data1}$ comprises data information of even-numbered column pixels of a frame of image to be displayed, and the second set of image data signals $S_{data2}$ comprises data information of odd-numbered column pixels of the frame of image. The image data segmenting device 102 may employ any suitable image data segmenting method known in the related art. The data source 200 may be any apparatus known in the related art that is suitable for providing image data that need to be displayed for the display apparatus. For example, the data source 200 may be a storage device storing image data that need to be displayed, including but not limited to, e.g., an optical disk memory, a magnetic disk memory, or a semiconductor memory, or the like. In addition, the data source 200 may also be any suitable network transmission apparatus, which may acquire image data that need to be displayed from the Internet or other wired or wireless telecommunication systems, including but not limited to, e.g., a set-top box.

Figure 2:
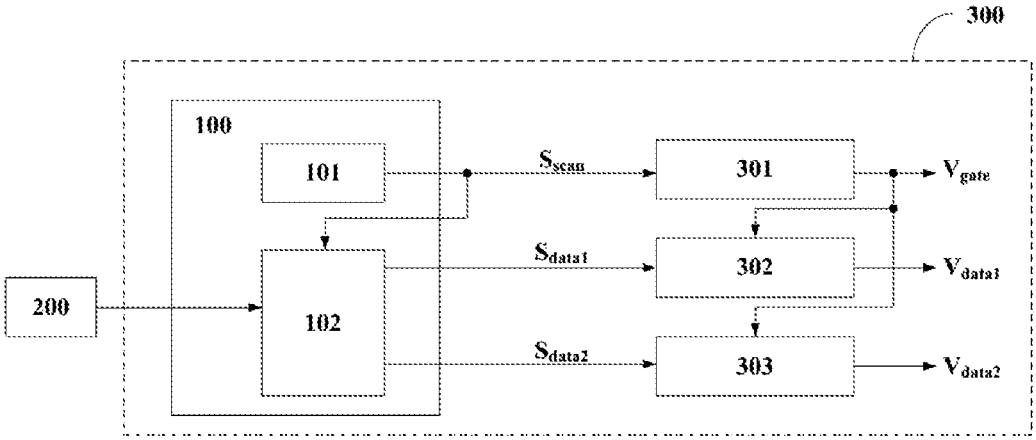
FIG. 2 is a schematic structural block diagram of a display driving device according to an embodiment of the present disclosure.

Now with reference to FIG. 2, it shows a schematic structural block diagram of a display driving device 300 according to an embodiment of the present disclosure. The display driving device 300 comprises the signal controlling device 100 shown in FIG. 1. In addition, the display driving device 300 further comprises a pixel array driver 301, a first data driver 302 and a second data driver 303. The pixel array driver 301 receives the scanning signal $S_{scan}$ and initiates the scanning of the pixel array of the display apparatus in response to the scanning signal $S_{scan}$ to generate a pixel array driving signal $V_{gate}$ and apply it to the pixel array, so as to switch on the pixel units in the pixel array row by row. According to an embodiment of the present disclosure, the pixel array driver 301 may comprise a gate driver on array (GOA) circuit, and the pixel array driving signal $V_{gate}$ may be a gate line driving signal; and under such circumstances, when the scanning signal $S_{scan}$ is received, the GOA circuit can output the gate line driving signal to the pixel array row by row so as to switch on the pixel units in the pixel array row by row. In addition, in the embodiment shown in FIG. 2, the pixel array driver 301 also transmits the pixel array driving signal $V_{gate}$ to the first data driver 302 and the second data driver 303. The first data driver 302 receives the pixel array driving signal $V_{gate}$ and the first set of image data signals $S_{data1}$, and generates a first set of data driving signals $V_{data1}$ in response to the received signals, and the first data driver 302 may supply power to the corresponding pixel units of the first set of pixel units in the row of switched-on pixel units based on the first set of data driving signals $V_{data1}$ The second data driver 303 receives the pixel array driving signal $V_{gate}$ and the second set of image data signals $S_{data2}$, and generates a second set of data driving signals $V_{data2}$ in response to the received signals, and the second data driver 303 may supply power to the corresponding pixel units of the second set of pixel units in the row of switched-on pixel units based on the second set of data driving signals $V_{data2}$. After the pixel array driver 301 finishes the switch-on of the pixel units in the pixel array row by row, the first data driver 302 and the second data driver 303 also correspondingly output all the data of the frame of image to be displayed to the pixel array of the display apparatus, so as to realize the display of the frame of image.

Figure 3:
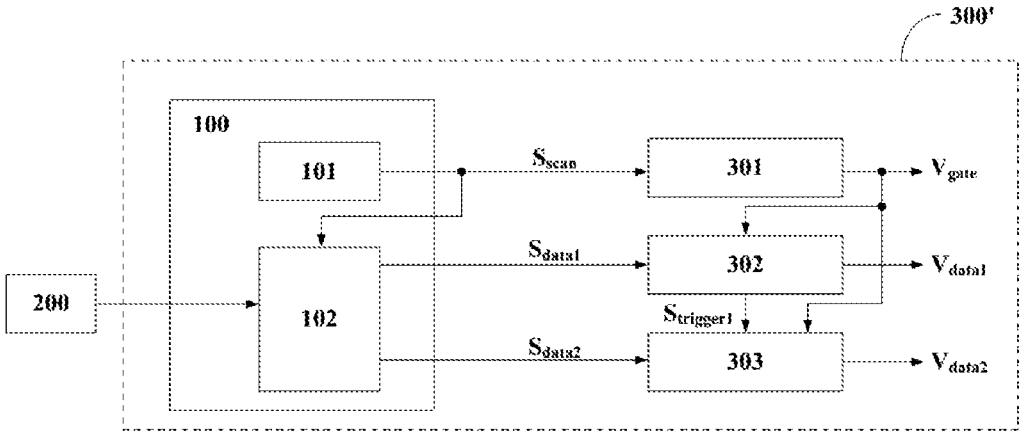
FIG. 3 is a schematic structural block diagram of a display driving device according to another embodiment of the present disclosure.
Figure 4:
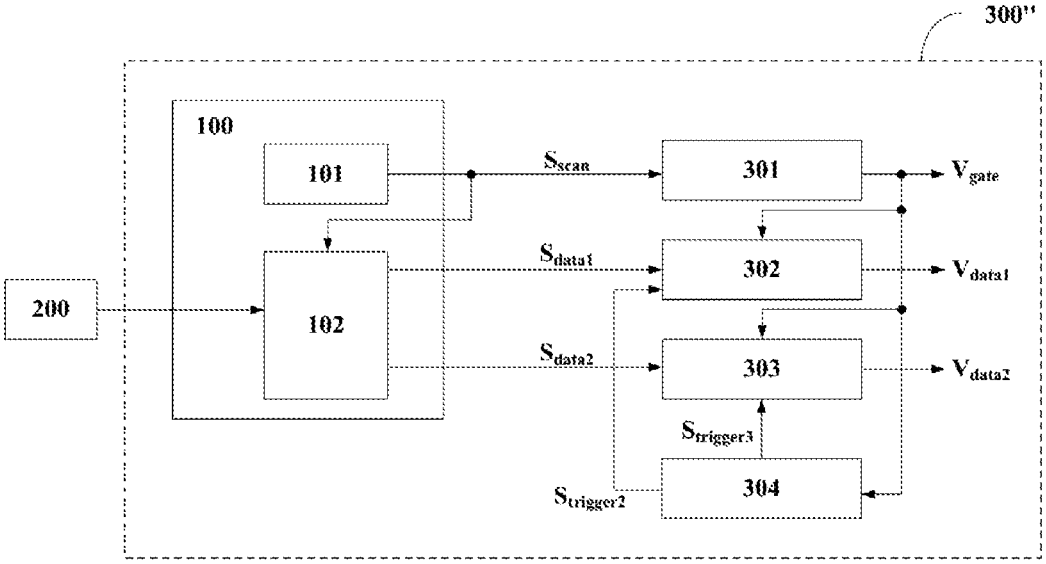
FIG. 4 is a schematic structural block diagram of a display driving device according to a further embodiment of the present disclosure.

Now turn to FIGS. 3 and 4, which respectively show the display driving devices according to some other embodiments of the present disclosure. The display driving devices shown in FIGS. 3 and 4 differ from the display driving device 300 shown in FIG. 2 only in a few aspects, which will be described hereinafter.

FIG. 3 shows the display driving device 300'. In comparison with the display driving device 300 shown in FIG. 2, the display driving device 300' only differs in that the first data driver 302 may also generate a first triggering signal $S_{trigger1}$ during the power supply to the corresponding pixel units of the first set of pixel units in the row of switched-on pixel units based on the first set of data driving signals $V_{data1}$, and transmit the first triggering signal $S_{trigger1}$ to the second data driver 303 so that the second data driver 303 may start the power supply to the corresponding pixel units of the second set of pixel units in the row of switched-on pixel units at a certain moment in response to the first triggering signal $S_{trigger1}$. In some embodiments of the present disclosure, the certain moment corresponding to the first triggering signal $S_{trigger1}$ may be, for instance, but not limited to, the time when the first data driver 302 starts the power supply to the corresponding pixel units of the first set of pixel units, or the time when the first data driver 302 ends the power supply to the corresponding pixel units of the first set of pixel units, that is to say, the time when the first set of data driving signals $V_{data1}$ starts or ends. Therefore, the display driving device according to the embodiment of the present disclosure may simultaneously or successively supply power to the first set of pixel units and the second set of pixel units in the row of the pixel units during the switch-on of the row of the pixel units.

FIG. 4 shows the display driving device 300". In comparison with the display driving device 300 shown in FIG. 2, the display driving device 300" also comprises a synchronous controlling device 304. The pixel array driver 301 also transmits the pixel array driving signal $V_{gate}$ to the synchronous controlling device 304. The synchronous controlling device 304 generates a second triggering signal $S_{trigger2}$ and a third triggering signal $S_{trigger3}$ in response to the pixel array driving signal $V_{gate}$, and sends the second triggering signal $S_{trigger2}$ to the first data driver 302 and the third triggering signal $S_{trigger3}$ to the second data driver 303. The first data driver 302 starts to supply power to the corresponding pixel units of the first set of pixel units in response to the second triggering signal $S_{trigger2}$, and the second data driver 303 starts to supply power to the corresponding pixel units of the second set of pixel units in response to the third triggering signal $S_{trigger3}$. It shall be understood that the second triggering signal $S_{trigger2}$ and the third triggering signal $S_{trigger3}$ may be generated simultaneously, or successively, so as to realize the simultaneous or successive power supply to the first set of pixel units and the second set of pixel units in the row of switched-on pixel units.

By way of the display driving device according to the present disclosure, the pixel array driving signal $V_{gate}$ may be used to simultaneously control two sets of data driving signals to supply power to two sets of pixel units in the same row, so as to avoid the problem of poor synchronization of two sets of pixel array driving signals (for example, two sets of gate line driving signals) caused by the difference in line resistances, thereby ensuring that images displayed on the display apparatus are better matched when an ultra-high resolution image is displayed.

Figure 5:
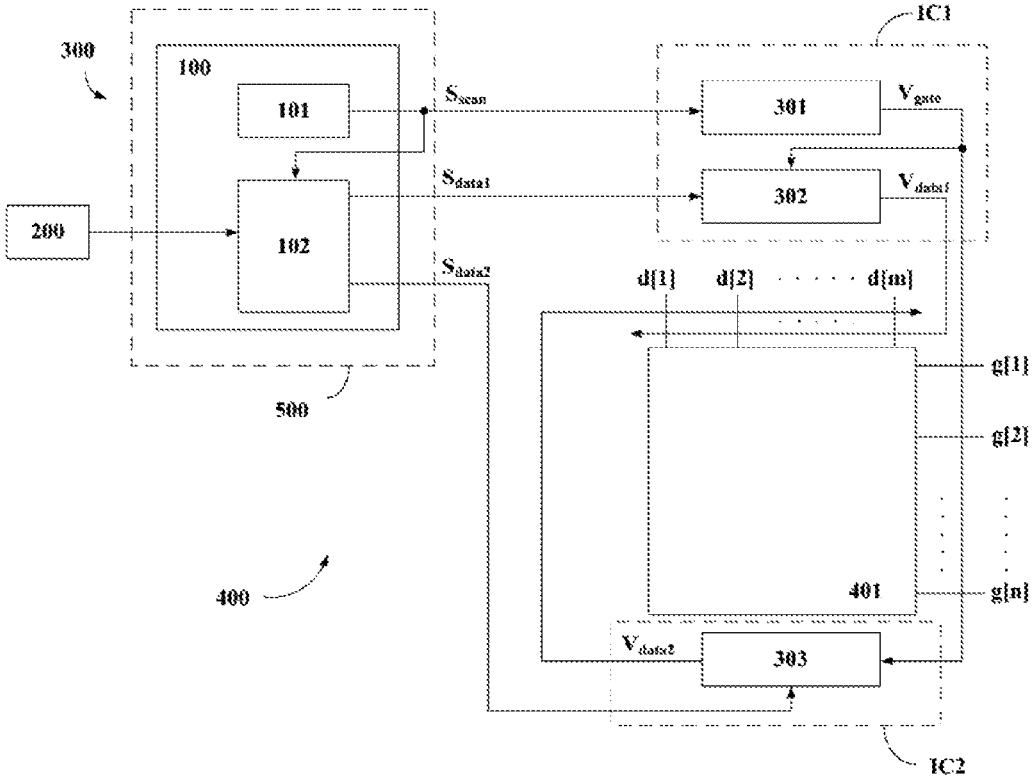
FIG. 5 is a schematic structural block diagram of a display apparatus according to an embodiment of the present disclosure.

Then reference is made to FIG. 5 which shows a display apparatus 400 according to an embodiment of the present disclosure. The display apparatus 400 comprises the display driving device 300 as stated above. It shall be understood that the display apparatus 400 may also comprise the display driving devices 300' and 300" as shown in FIGS. 3 and 4, and the description about the display apparatus 400 hereinafter is also applicable to the display apparatus comprising the display driving devices 300' and 300". As shown in FIG. 5, the display apparatus 400 further comprises a display panel 401. The display panel 401 comprises a pixel array, and has n row driving lines g[1], g[2], . . . g[n] and m data lines d[1], d[2], . . . d[m], wherein n and m are both integers greater than 1. When the pixel array driving signal $V_{gate}$ is applied to one of the n row driving lines g[1], g[2], . . . g[n], the row of pixel units corresponding to the row driving line is switched on, and the signals applied on the m data lines d[1], d[2], . . . d[m] may supply power to the row of pixel units. The output of the first data driver 302 is connected with a first set of data lines of the m data lines d[1], d[2], . . . d[m], and the output of the second data driver 303 is connected with a second set of data lines of them data lines d[1], d[2], . . . d[m]. In an embodiment of the present application, the first set of data lines may consist of even-numbered data lines, thereby controlling the power supply to the even-numbered column pixel units in the pixel array, and the second set of data lines may consist of odd-numbered data lines, thereby controlling the power supply to the odd-numbered column pixel units in the pixel array.

As shown in FIG. 5, the pixel array driving signal $V_{gate}$ outputted by the pixel array driver 301 may be, for example, but not limited to, a gate line driving signal outputted by the GOA driving circuit that is successively applied to the n row driving lines g[1], g[2], . . . g[n], thereby switching on the pixel units in the pixel array row by row. In addition, the pixel array driving signal $V_{gate}$ may be simultaneously transmitted to the first data driver 302 and the second data driver 303. In response to the received signals, the first data driver 302 may generate the first set of data driving signals $V_{data1}$ and the second data driver 303 may generate the second set of data driving signals $V_{data2}$. The first data driver 302 may apply the first set of data driving signals $V_{data1}$ to the first set of data lines of them data lines d[1], d[2], . . . d[m], so as to supply power to the first set of pixel units in the row of switched-on pixel units, and the second data driver 303 may apply the second set of data driving signals $V_{data2}$ to the second set of data lines of the m data lines d[1], d[2], . . . d[m], so as to supply power to the second set of pixel units in the row of switched-on pixel units.

FIG. 5 also shows an exemplary hardware arrangement of the display driving device according to an embodiment of the present disclosure. As shown in FIG. 5, the pixel array driver 301 and the first data driver 302 may be integrated in a first chip IC1, the second data driver 303 may be integrated in a second chip IC2, and the scanning signal controlling device 101 and the image data segmenting device 102 (namely, the signal controlling device 100) may be integrated in a processor 500. The processor 500 may be any suitable microprocessor, microchip, logic circuit, etc. known in the related art. The first chip IC1 and the second chip IC2 may be connected to the processor 500 by a flexible circuit board, so as to realize the communication between the processor 500 and the first chip IC1, as well as the second chip IC2.

In the related art, when two chips (e.g., the first chip IC1 and the second chip IC2) are used together, which are usually arranged on one side of the display panel in a way of single side arrangement. However, this also reduces the usable area of the side that is provided with two chips in the display panel, resulting in a complex fan-out wiring. In addition, some existing display apparatuses (such as, a VR display apparatus) are often small in size, such that it is difficult to arrange two chips on one single side.

In the display apparatus 400 according to the embodiment of the present disclosure, the first chip IC1 and the second chip IC2 may be respectively arranged on two opposite sides of the display panel 401. As shown in FIG. 5, the first chip IC1 is arranged on the upper side of the display panel 401, and the second chip IC2 is arranged on the lower side of the display panel 401. It should be understood, however, that the arrangement shown in FIG. 5 is merely exemplary and not restrictive. The first chip IC1 may be arranged on the lower side of the display panel 401, and the second chip IC2 may also be arranged on the upper side of the display panel 401. In addition, the first chip IC1 and the second chip IC2 may also be arranged on the left and right sides of the display panel 401 respectively. In this way, more area may be left on the side of the display panel, which is provided with the chips, for the fan-out wiring. In addition, when the first chip IC1 and the second chip IC2 in the embodiment of the present disclosure are arranged on different sides of the display panel 401, they may be arranged in the frame area of the display panel 401 by a Chip On Plastic (COP) process or a Chip On Glass (COG) process, that is, the first chip IC1 and the second chip IC2 are located at the periphery of the display area of the display panel 401.

It should be noted that when in use, the signal controlling device, display driving device and display apparatus provided by the embodiments of the present disclosure can meet the requirements of ultra-high resolution images (when the image resolution>850 PPI), and the hardware of the display apparatus can support ultra-high resolution image display. As an example, Table 1 exemplarily shows the hardware parameters of a VR display apparatus.

TABLE 1

Hardware Parameters of the VR Display Apparatus

| Parameters | Values |
|---|---|
| size of the display area | 2.0 inch~3.5 inch |
| resolution of panel | 2160 × RGB × 2160/2880 × GB × 3240 |
| resolution of chip | 1080 × RGB × 2160 (supporting R66451)<br>1440 × RGB × 3240 (TBD) |
| frame frequency | 60 Hz/90 Hz/120 Hz |
| FPGA | supporting HPPI interface of C-PHY<br>supporting 60 Hz/90 Hz/120 Hz<br>supporting 2160 × 2160/2880 × 3240 |

Figure 6:
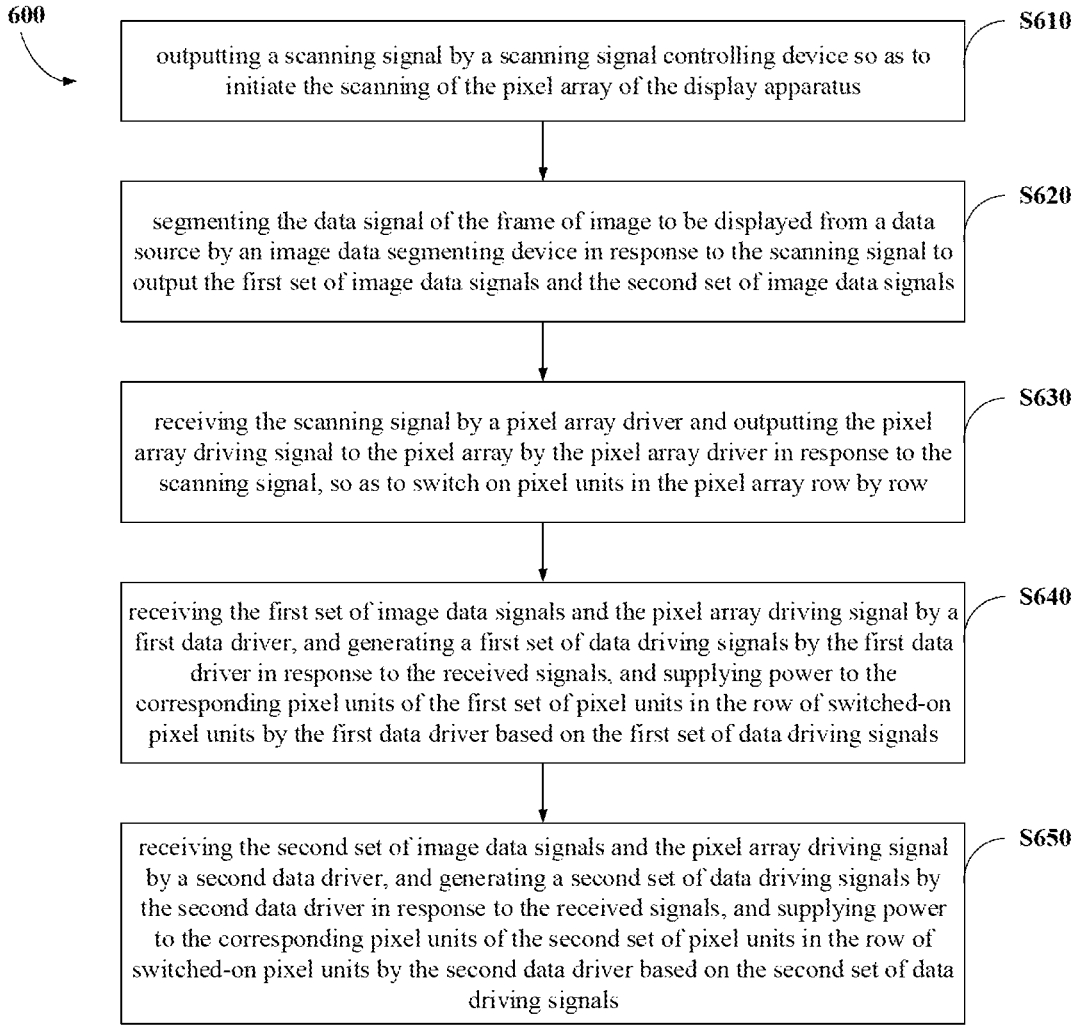
FIG. 6 is a flow chart of a display driving method according to an embodiment of the present disclosure.

Now referring to FIG. 6, it shows a flow chart of a display driving method 600 for driving the display apparatus according to the disclosure, according to an embodiment of the present disclosure. It should be noted that the steps in the method described below are not necessarily executed in the order as listed. Instead, one or more of these steps may be executed in a different order or at the same time according to the actual situations.

The display driving method 600 comprises the steps of:

S610: outputting a scanning signal $S_{scan}$ by a scanning signal controlling device 100 so as to initiate the scanning of the pixel array of the display apparatus;

S620: segmenting the data signal of the frame of image to be displayed from a data source 200 by an image data segmenting device 120 in response to the scanning signal $S_{scan}$ to output the first set of image data signals $S_{data1}$ and the second set of image data signals $S_{data2}$;

S630: receiving the scanning signal $S_{scan}$ by a pixel array driver 301 and outputting the pixel array driving signal $V_{gate}$ to the pixel array by the pixel array driver 301 in response to the scanning signal $S_{scan}$, so as to switch on pixel units in the pixel array row by row;

S640: receiving the first set of image data signals $S_{data1}$ and the pixel array driving signal $V_{gate}$ by a first data driver 302, and generating a first set of data driving signals $V_{data1}$ by the first data driver 302 in response to the received signals, and supplying power to the corresponding pixel units of the first set of pixel units in the row of switched-on pixel units by the first data driver 302 based on the first set of data driving signals $V_{data1}$; and S650: receiving the second set of image data signals $S_{data2}$ and the pixel array driving signal $V_{gate}$ by a second data driver 303, and generating a second set of data driving signals $V_{data2}$ by the second data driver 303 in response to the received signals, and supplying power to the corresponding pixel units of the second set of pixel units in the row of switched-on pixel units by the second data driver 303 based on the second set of data driving signals $V_{data2}$.

Figure 7:
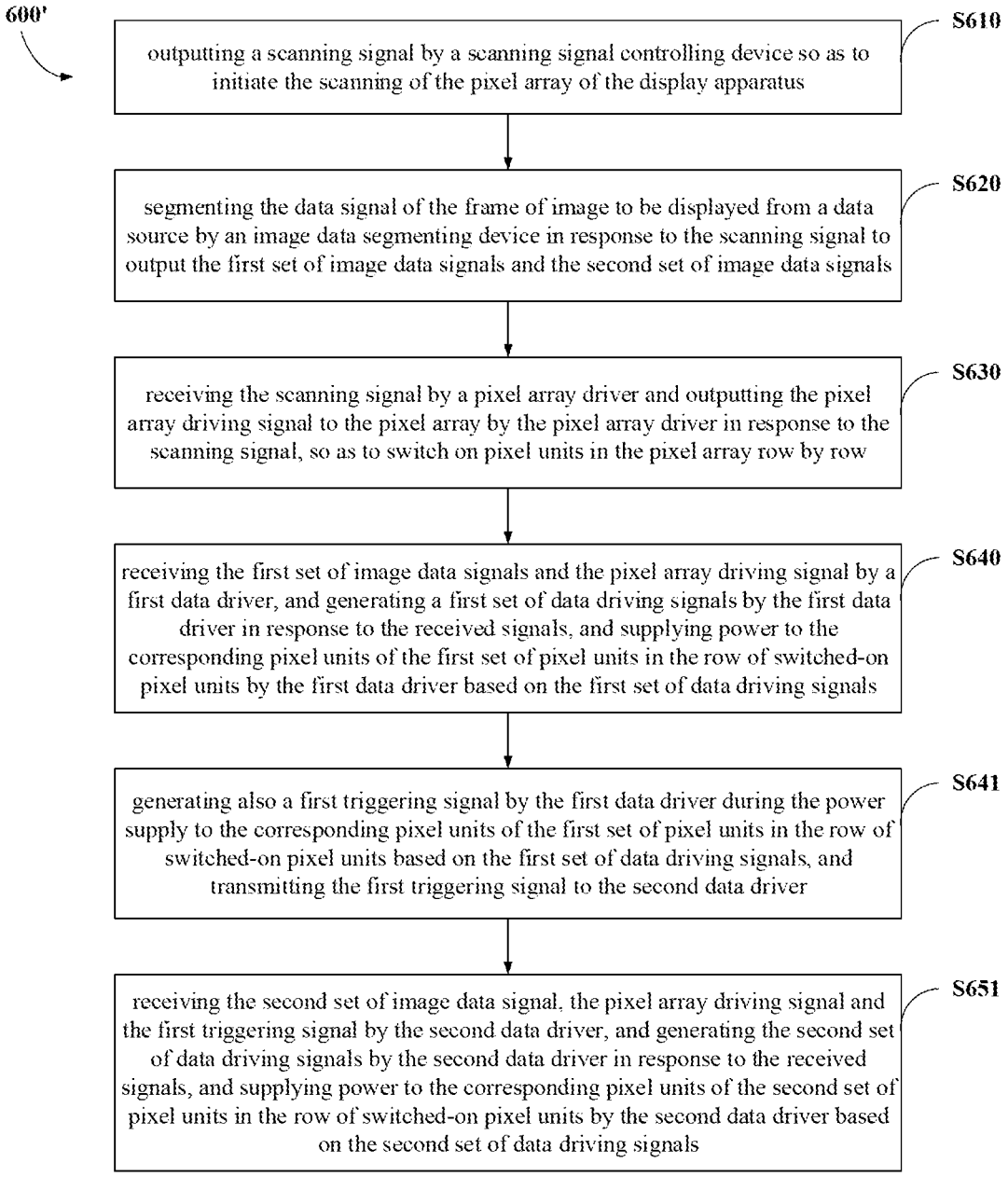
FIG. 7 is a flow chart of a display driving method according to another embodiment of the present disclosure.

FIG. 7 shows a flow chart of a display driving method 600' according to another embodiment of the present disclosure. In comparison with the display driving method 600 as shown in FIG. 6, the display driving method 600' differs only in that the step S650 is replaced by the following steps:

S641: generating also a first triggering signal $S_{trigger1}$ by the first data driver 302 during the power supply to the corresponding pixel units of the first set of pixel units in the row of switched-on pixel units based on the first set of data driving signals $V_{data1}$, and transmitting the first triggering signal $S_{trigger1}$ to the second data driver 303; and S651: receiving the second set of image data signal $S_{data2}$, the pixel array driving signal $V_{gate}$ and the first triggering signal $S_{trigger1}$ by the second data driver 303, and generating the second set of data driving signals $V_{data2}$ by the second data driver 303 in response to the received signals, and supplying power to the corresponding pixel units of the second set of pixel units in the row of switched-on pixel units by the second data driver 303 based on the second set of data driving signals $V_{data2}$.

In an embodiment of the present disclosure, the first triggering signal $S_{trigger1}$ may be generated at a specific time during the power supply from the first data driver 302 to the corresponding pixel units, for example, at the beginning of the power supply from the first data driver 302 to the corresponding pixel units of the first set of pixel units, or at the end of the power supply from the first data driver 302 to the corresponding pixel units of the first set of pixel units, so that the second data driver 303 starts the power supply at the specific time in response to the first triggering signal $S_{trigger1}$.

Figure 8:
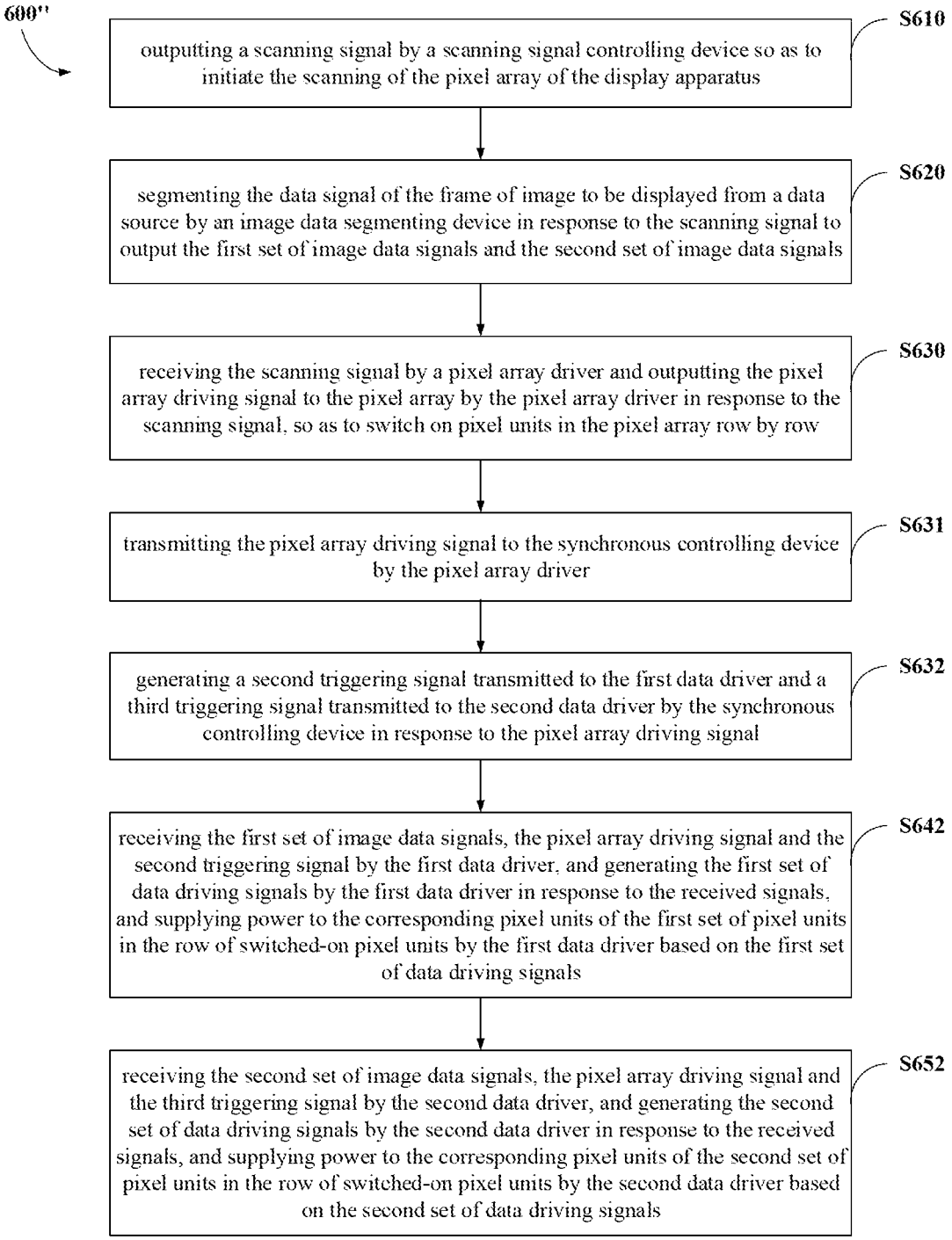
FIG. 8 is a flow chart of a display driving method according to a further embodiment of the present disclosure.

FIG. 8 shows a flow chart of a display driving method 600" according to a further embodiment of the present disclosure. In comparison with the display driving method 600 as shown in FIG. 6, the display driving method 600" differs in that the display driving device further comprises a synchronous controlling device 304, and therefore the steps S640 and S650 of the display driving method 600 are replaced by the following steps:

S631: transmitting the pixel array driving signal $V_{gate}$ to the synchronous controlling device 304 by the pixel array driver 301;

S632: generating a second triggering signal $S_{trigger2}$ transmitted to the first data driver 302 and a third triggering signal $S_{trigger3}$ transmitted to the second data driver 303 by the synchronous controlling device 304 in response to the pixel array driving signal $V_{gate}$;

S642: receiving the first set of image data signals $S_{data1}$, the pixel array driving signal $V_{gate}$ and the second triggering signal $S_{trigger2}$ by the first data driver 302, and generating the first set of data driving signals $V_{data1}$ by the first data driver 302 in response to the received signals, and supplying power to the corresponding pixel units of the first set of pixel units in the row of switched-on pixel units by the first data driver 302 based on the first set of data driving signals $V_{data1}$; and S652: receiving the second set of image data signals $S_{data2}$, the pixel array driving signal $V_{gate}$ and the third triggering signal $S_{trigger3}$ by the second data driver 303, and generating the second set of data driving signals $V_{data2}$ by the second data driver 303 in response to the received signals, and supplying power to the corresponding pixel units of the second set of pixel units in the row of switched-on pixel units by the second data driver 303 based on the second set of data driving signals $V_{data2}$.

In some embodiments of the present disclosure, the second triggering signal $S_{trigger2}$ and the third triggering signal $S_{trigger3}$ may be generated simultaneously or successively.

It should be understood that the methods according to the embodiments of the present disclosure may be in the form of a computer program run by a computer. Computers can be, e.g., processors, microprocessors, microchips, logic circuits, etc. Computer programs may be stored/distributed on a suitable computer-readable volatile or non-volatile media, including but not limited to, for example, an optical storage media or solid-state media provided together with or as part of other hardware, but may also be distributed in other forms, including but not limited to, for example, via the Internet or other wired or wireless telecommunication systems.

The above description is only an exemplary embodiment of the present disclosure, but the present disclosure is not limited to thereto. Any person skilled in the art may envisage other possible changes, modifications or replacements based on the above teachings of the present disclosure, which are considered to fall within the scope of protection of the present disclosure. Therefore, the scope of protection of the disclosure shall depend on the appended claims.

What is claimed is:

1. A display driving device for driving a display apparatus comprising a pixel array, comprising:

a signal controlling device for providing an image data signal for the display apparatus, comprising:

a scanning signal controlling device configured to output a scanning signal that initiates a scanning of the pixel array; and an image data segmenting device configured to receive the scanning signal and a data signal representing a frame of image from a data source, and to segment the data signal in response to the scanning signal to output a first set of image data signals and a second set of image data signals, wherein first set of image data signals comprises data information of a first set of column pixels in the frame of image and the second set of image data signals comprises data information of a second set of column pixels in the frame of image;

a pixel array driver comprising a GOA circuit, wherein the GOA circuit is configured to receive the scanning signal and generate a gate line driving signal in response to the scanning signal, to switch on pixel units in each row in the pixel array row by row;

a first data driver configured to receive the first set of image data signals and the gate line driving signal, generate a first set of data driving signals in response to the first set of image data signals and the gate line driving signal that were received, and supply power to corresponding pixel units of a first set of pixel units in a row of switched-on pixel units based on the first set of data driving signals; and a second data driver configured to receive the second set of image data signals and the gate line driving signal, generate a second set of data driving signals in response to the second set of image data signals and the gate line driving signal that were received, and supply power to corresponding pixel units of a second set of pixel units in a row of switched-on pixel units based on the second set of data driving signals, wherein the gate line driving signal is used to simultaneously control the first set of data driving signals and the second set of data driving signals to supply power to the corresponding pixel units of the first set of pixel units and the corresponding pixel units of the second set of pixel units in a same row.

2. The display driving device according to claim 1, wherein the first data driver is further configured to generate a first triggering signal while supplying power to the corresponding pixel units of the first set of pixel units in the row of switched-on pixel units based on the first set of data driving signals, and to transmit the first triggering signal to the second data driver so that the second data driver starts supplying power in response to the first triggering signal.

3. The display driving device according to claim 2, wherein the first data driver is further configured to generate the first triggering signal at a starting of supplying power to the corresponding pixel units of the first set of pixel units, or the first data driver is further configured to generate the first triggering signal at an ending of supplying power to the corresponding pixel units of the first set of pixel units.

4. The display driving device according to claim 1, wherein the display driving device comprises a synchronous controlling device, wherein the synchronous controlling device is configured to receive the gate line driving signal, and is configured to transmit a second triggering signal to the first data driver and a third triggering signal to the second data driver in response to the gate line driving signal, wherein the first data driver is configured to supply power to the corresponding pixel units of the first set of pixel units in the row of switched-on pixel units in response to the second triggering signal, and wherein the second data driver is configured to supply power to the corresponding pixel unit of the second set of pixel units in the row of switched-on pixel units in response to the third triggering signal.

5. A display apparatus, comprising:

a display panel comprising a pixel array, the display panel comprising n row driving lines and m data lines, n and m being integers greater than 1; and the display driving device according to claim 1;

wherein an output of the pixel array driver is connected to the n row driving lines; and wherein an output of the first data driver is connected with a first set of data lines of them data lines, and an output of the second data driver is connected with a second set of data lines of the m data lines.

6. The display apparatus according to claim 5, wherein the display panel comprises a liquid crystal display panel or an OLED display panel.

7. The display apparatus according to claim 5, wherein the pixel array driver and the first data driver are integrated in a first chip, the second data driver is integrated in a second chip, and the first chip and the second chip are arranged in a same frame area of the display panel.

8. The display apparatus according to claim 5, wherein the pixel array driver and the first data driver are integrated in a first chip, the second data driver is integrated in a second chip, and the first chip and the second chip are respectively in opposite frame areas of the display panel.

9. The display apparatus according to claim 7, wherein the signal controlling device is integrated in a processor which is connected to the first chip and the second chip by a flexible circuit board.

10. The display apparatus according to claim 5, wherein the first set of data lines corresponds to a first set of column pixel units in the pixel array, and the second set of data lines corresponds to a second set of column pixel units in the pixel array.

11. The display apparatus according to claim 10, wherein the first set of column pixel units comprises even-numbered column pixel units in the pixel array, and the second set of column pixel units comprises odd-numbered column pixel units in the pixel array.

12. A display driving method for driving the display apparatus according to claim 5, the display driving method comprising:

a) outputting a scanning signal by the scanning signal controlling device to initiate the scanning of the pixel array of the display apparatus;

b) segmenting the data signal of the frame of image by the image data segmenting device in response to the scanning signal to output the first set of image data signals and the second set of image data signals;

c) receiving the scanning signal by the pixel array driver and outputting gate line driving signal to the pixel array by the pixel array driver in response to the scanning signal, to switch on pixel units in each row in the pixel array row by row;

d) receiving the first set of image data signals and the gate line driving signal by the first data driver, and generating the first set of data driving signals by the first data driver in response to the first set of image data signals and the gate line driving signal that were received, and supplying power to the corresponding pixel units of the first set of pixel units in the row of switched-on pixel units by the first data driver based on the first set of data driving signals; and e) receiving the second set of image data signals and the gate line driving signal by the second data driver, and generating the second set of data driving signals by the second data driver in response to the second set of image data signals and the gate line driving signal that were received, and supplying power to the corresponding pixel units of the second set of pixel units in the row of switched-on pixel units by the second data driver based on the second set of data driving signals.

13. The display driving method according to claim 12, wherein e) of the display driving method is replaced by operations comprising:

f) generating a first triggering signal by the first data driver during supplying of power to the corresponding pixel units of the first set of pixel units in the row of switched-on pixel units based on the first set of data driving signals, and transmitting the first triggering signal to the second data driver; and g) receiving the second set of image data signals, the gate line driving signal and the first triggering signal by the second data driver, and generating the second set of data driving signals by the second data driver in response to second set of image data signals, the gate line driving signal and the first triggering signal that were received, and supplying power to the corresponding pixel units of the second set of pixel units in the row of switched-on pixel units by the second data driver based on the second set of data driving signals.

14. The display driving method according to claim 13, wherein the first triggering signal is generated when the first data driver starts supplying power to the corresponding pixel units of the first set of pixel units, or the first triggering signal is generated when the first data driver ends supplying power to the corresponding pixel units of the first set of pixel units.

15. The display driving method according to claim 12, wherein the display driving device also comprises a synchronous controlling device, and d) and e) of the display driving method are replaced by operations comprising:

h) transmitting the gate line driving signal to the synchronous controlling device by the pixel array driver;

i) generating a second triggering signal transmitted to the first data driver and a third triggering signal transmitted to the second data driver by the synchronous controlling device in response to the gate line driving signal;

j) receiving the first set of image data signals, the gate line driving signal and the second triggering signal by the first data driver, and generating the first set of data driving signals by the first data driver in response to the first set of image data signals, the gate line driving signal and the second triggering signal that were received, and supplying power to the corresponding pixel units of the first set of pixel units in the row of switched-on pixel units by the first data driver based on the first set of data driving signals; and k) receiving the second set of image data signals, gate line driving signal and the third triggering signal by the second data driver, and generating the second set of data driving signals by the second data driver in response to the second set of image data signals, the gate line driving signal and the third triggering signal that were received, and supplying power to the corresponding pixel units of the second set of pixel units in the row of switched-on pixel units by the second data driver based on the second set of data driving signals.

16. A display driving device for driving a display apparatus comprising a pixel array, the display driving device comprising:

a signal controlling device for providing an image data signal for the display apparatus, comprising:

a scanning signal controlling device configured to output a scanning signal that initiates a scanning of the pixel array; and an image data segmenting device configured to receive the scanning signal and a data signal representing a frame of image from a data source, and to segment the data signal in response to the scanning signal to output a first set of image data signals and a second set of image data signals, wherein the first set of image data signals comprises data information of even-numbered column pixels in the frame of image and the second set of image data signals comprises data information of odd-numbered column pixels in the frame of image;

a pixel array driver comprising a GOA circuit, wherein the GOA circuit is configured to receive the scanning signal and generate a gate line driving signal in response to the scanning signal, to switch on pixel units in each row in the pixel array row by row;

a first data driver configured to receive the first set of image data signals and the gate line driving signal, generate a first set of data driving signals in response to the first set of image data signals and the gate line driving signal that were received, and supply power to corresponding pixel units of a first set of pixel units in the row of switched-on pixel units based on the first set of data driving signals; and a second data driver configured to receive the second set of image data signals and the gate line driving signal, generate a second set of data driving signals in response to the second set of image data signals and the gate line driving signal that were received, and supply power to corresponding pixel units of a second set of pixel units in the row of switched-on pixel units based on the second set of data driving signals, wherein the gate line driving signal is used to simultaneously control the first set of data driving signals and the second set of data driving signals to supply power to the corresponding pixel units of the first set of pixel units and the corresponding pixel units of the second set of pixel units in a same row.

17. A display apparatus, comprising:

a display panel comprising a pixel array, the display panel comprising n row driving lines and m data lines, n and m being integers greater than 1; and the display driving device according to claim 16;

wherein an output of the pixel array driver is connected to the n row driving lines; and wherein an output of the first data driver is connected with a first set of data lines of them data lines, and an output of the second data driver is connected with a second set of data lines of the m data lines.

* * * * *